US007159385B2

(12) United States Patent
Uchida

(10) Patent No.: US 7,159,385 B2
(45) Date of Patent: Jan. 9, 2007

(54) APPARATUS FOR AND METHOD OF DETECTING DETERIORATION OF CATALYST IN INTERNAL COMBUSTION ENGINE

(75) Inventor: Takahiro Uchida, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 41 days.

(21) Appl. No.: 11/010,353

(22) Filed: Dec. 14, 2004

(65) Prior Publication Data

US 2005/0150208 A1 Jul. 14, 2005

(30) Foreign Application Priority Data

Dec. 16, 2003 (JP) ..... 2003-418043

(51) Int. Cl.
*F01N 3/00* (2006.01)

(52) U.S. Cl. ..... 60/277; 60/274; 60/276; 60/285; 123/443

(58) Field of Classification Search ..... 60/274, 60/276, 277, 285; 123/443
See application file for complete search history.

(56) References Cited

U.S. PATENT DOCUMENTS 5,515,826 A * 5/1996 Hamburg et al. ..... 123/406.47
5,656,765 A 8/1997 Gray
5,713,199 A * 2/1998 Takeshima et al. ..... 60/276
6,487,849 B1 * 12/2002 Bidner et al. ..... 60/274
6,567,738 B1 * 5/2003 Gopp et al. ..... 701/109
6,594,989 B1 * 7/2003 Hepburn et al. ..... 60/286
6,668,813 B1 * 12/2003 Azuma et al. ..... 123/687
2002/0157379 A1 10/2002 Kakuyama et al.

FOREIGN PATENT DOCUMENTS

JP A 6-81632 3/1994
JP A 2000-8838 1/2000
JP A 2002-130018 5/2002
JP A 2004-108187 4/2004

* cited by examiner

*Primary Examiner*—Binh Q. Tran
(74) *Attorney, Agent, or Firm*—Oliff & Berridge, PLC

(57) ABSTRACT

An apparatus for detecting deterioration of a catalyst in an internal combustion engine initially biases an air/fuel ratio of an air-fuel mixture supplied to the internal combustion engine to a rich amount so that an amount of oxygen stored in the catalyst is substantially zero. Then, the apparatus detects deterioration of the catalyst by alternating the air/fuel ratio lean or rich based on an amount of oxygen given to the catalyst. If the catalyst has deteriorated, a bias amount of the air/fuel ratio is set so that the amount of oxygen stored in the catalyst is substantially saturated. If the catalyst is normal, a bias amount of the air/fuel ratio is set so that the amount of oxygen stored in the catalyst is not saturated.

7 Claims, 6 Drawing Sheets

APPARATUS FOR AND METHOD OF DETECTING DETERIORATION OF CATALYST IN INTERNAL COMBUSTION ENGINE

BACKGROUND OF THE INVENTION

1. Field of the Invention

The present invention relates to an apparatus for and a method of detecting deterioration of a catalyst in an internal combustion engine and, more particularly, to improving the accuracy of catalyst deterioration diagnosis for an internal combustion engine.

2. Description of the Related Art

A technique in which a means for changing the air-fuel ratio to detect deterioration of a catalyst sets the changing range so that the amount of oxygen storage is within the range between a breakthrough amount of an aged catalyst (i.e., oxygen storage capacity of the catalyst) and a breakthrough amount of a normal catalyst, has been proposed (see, for example, Japanese Patent Laid-Open No. 2002-130018). The amount of oxygen storage is calculated by detecting the concentration of oxygen in exhaust gas with an oxygen sensor provided downstream of the catalyst.

In such a conventional catalyst deterioration detecting apparatus for internal combustion engines, however, the amount of oxygen storage is indeterminate when detecting deterioration of a catalyst is started and there is a possibility of a substantial output variation of the oxygen sensor even when the catalyst is normal and, hence, failure to accurately detect deterioration of the catalyst.

SUMMARY OF THE INVENTION

It is an object of the present invention to at least solve the problems in the conventional technology.

An apparatus for detecting deterioration of a catalyst in an internal combustion engine according to one aspect of the present invention initially biases an air/fuel ratio of an air-fuel mixture supplied to the internal combustion engine to a rich amount so that an amount of oxygen stored in the catalyst is substantially zero. Then, the apparatus detects deterioration of the catalyst by alternating the air/fuel ratio lean or rich based on an amount of oxygen given to the catalyst. If the catalyst has deteriorated, a bias amount of the air/fuel ratio is set so that the amount of oxygen stored in the catalyst is substantially saturated. If the catalyst is normal, a bias amount of the air/fuel ratio is set so that the amount of oxygen stored in the catalyst is not saturated.

An apparatus for detecting deterioration of a catalyst in an internal combustion engine according to another aspect of the present invention initially biases an air/fuel ratio of an air-fuel mixture supplied to the internal combustion engine to a lean amount so that an amount of oxygen stored in the catalyst is substantially saturated. Then the apparatus detects deterioration of the catalyst by alternating the air/fuel ratio lean or rich based on an amount of oxygen given to the catalyst. If the catalyst has deteriorated, a bias amount of the air/fuel ratio is set so that the amount of oxygen stored in the catalyst is substantially saturated. If the catalyst is normal, a bias amount of the air/fuel ratio is set so that the amount of oxygen stored in the catalyst is not saturated.

A method of detecting deterioration of a catalyst in an internal combustion engine according to still another aspect of the present invention includes: if initially biasing an air/fuel ratio of an air-fuel mixture supplied to the internal combustion engine to a rich amount, setting a target air/fuel ratio so that an amount of oxygen stored in the catalyst to substantially zero; if initially biasing an air/fuel ratio of an air-fuel mixture supplied to the internal combustion engine to a lean amount, setting a target air/fuel ratio so that an amount of oxygen stored in the catalyst to substantially saturated; and detecting deterioration of the catalyst by alternating the air/fuel ratio lean or rich based on an amount of oxygen given to the catalyst. If the catalyst has deteriorated, a bias amount of the air/fuel ratio is set so that the amount of oxygen stored in the catalyst is substantially saturated. If the catalyst is normal, a bias amount of the air/fuel ratio is set so that the amount of oxygen stored in the catalyst is not saturated.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments of a catalyst detecting apparatus and a catalyst detecting method for an internal combustion engine relating to the present invention will be described below in detail with reference to the accompanying drawings. The present invention is not limited to the embodiments described below.

Figure 1:
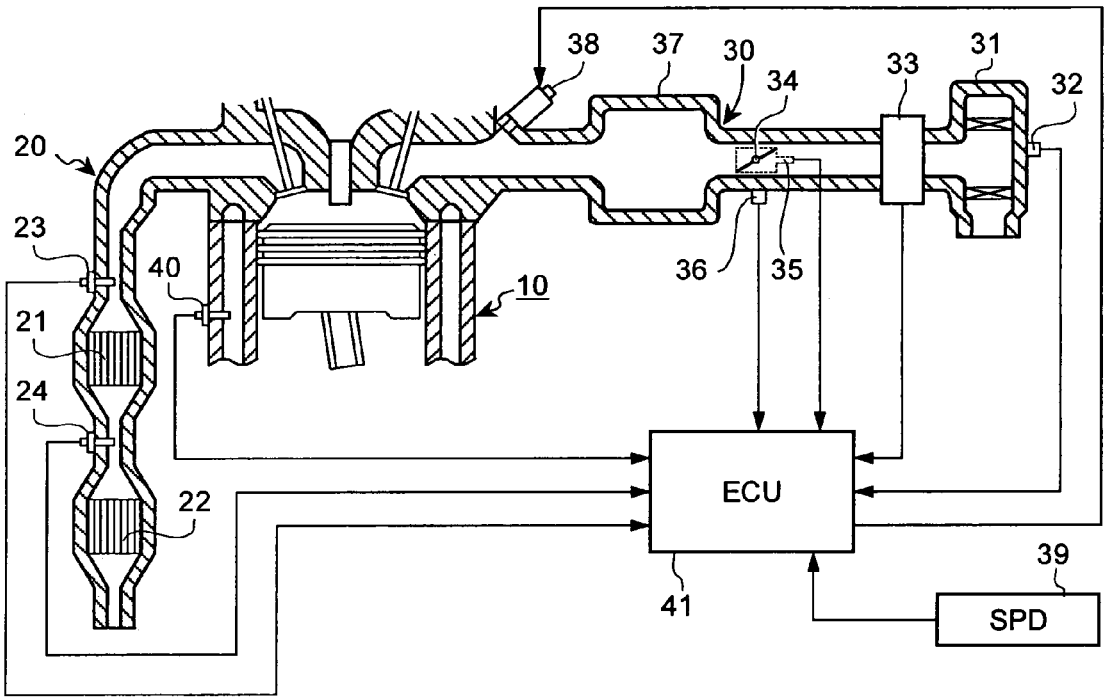
FIG. 1 is a schematic diagram showing an internal combustion engine with a catalyst deterioration detecting apparatus according to an embodiment of the present invention.
Figure 3:
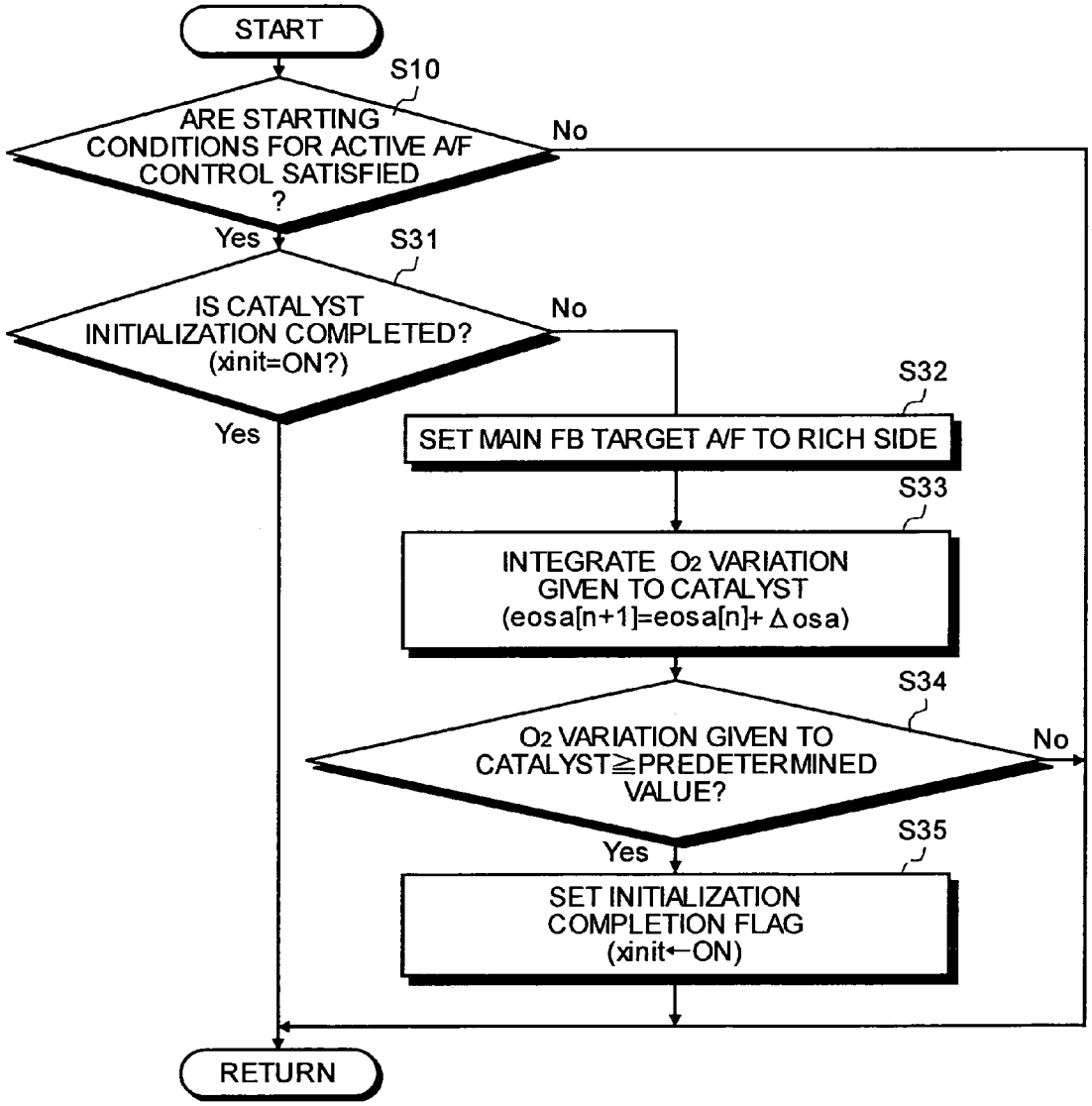
FIG. 3 is a flowchart of a control routine for initialization.

FIG. 1 is a schematic diagram showing an internal combustion engine with a catalyst deterioration detecting apparatus according to an embodiment of the present invention. An air intake pipe 30 and an exhaust pipe 20 are provided in an internal combustion engine 10, as shown in FIG. 3. An upstream catalyst 21 and a downstream catalyst 22, which are three way catalysts, are disposed in series in the exhaust pipe 20 to clean exhaust gas. That is, exhaust gas discharged from the internal combustion engine 10 is first cleaned by the upstream catalyst 21 and the exhaust gas not sufficiently cleaned by the upstream catalyst 21 is cleaned by the downstream catalyst 22.

These catalysts 21 and 22 are capable of storing a predetermined amount of oxygen. If unburned components such as hydrocarbon (HC) and carbon monoxide (CO) are contained in exhaust gas, the catalysts 21 and 22 can oxidize the unburned components by the oxygen stored in the catalysts. If oxides such as nitrogen oxides (NOx) are contained in exhaust gas, the catalysts 21 and 22 can reduce oxides and store the released oxygen.

An air/fuel ratio sensor (hereinafter, "main $O_2$ sensor") 23, which is for detecting the concentration of oxygen in exhaust gas, is provided upstream of the upstream catalyst 21. That is, the air/fuel ratio of the air-fuel mixture burned in the internal combustion engine is detected on the basis of the oxygen level in exhaust gas flowing into the upstream catalyst 21 with the main $O_2$ sensor 23.

An air/fuel ratio sensor (hereinafter, "sub $O_2$ sensor") 24, which is for detecting the concentration of oxygen in exhaust gas, is provided downstream of the upstream catalyst 21. That is, the sub $O_2$ sensor 24 detects whether exhaust gas is fuel-rich (containing HC and CO) or fuel-lean (containing NOx) on the basis of the oxygen level in the exhaust gas flowing out from the upstream catalyst 21. A temperature sensor (not shown) for detecting the exhaust gas temperature is also provided at the upstream catalyst 21.

In the air intake pipe 30 are provided an air filter 31, an intake air temperature sensor 32 for detecting the intake air temperature, an airflow meter 33 for detecting the air intake rate, a throttle valve 34, a throttle sensor 35 for detecting the throttle opening angle of the throttle valve 34, an idle switch 36 for detecting a fully closed state of the throttle valve 34, a surge tank 37, and a fuel injection valve 38.

Various sensors including the $O_2$ sensors 23 and 24, a speed sensor 39, and a cooling water temperature sensor 40 are connected to an electronic control unit (ECU) 41. Control of the internal combustion engine 10 and detecting deterioration of the catalysts are performed on the basis of the output values from the sensors 23 and 24.

In this embodiment, the main $O_2$ sensor 23 and the sub $O_2$ sensor 24 arranged as described above are used, the air/fuel ratio is biased to a rich or lean amount (hereinafter, "active A/F control"), a predetermined amount of oxygen which is determined based on a theoretical air-fuel ratio is provided for the catalyst 21, and the oxygen storage capacity (OSC) of the catalyst 21 is determined on the basis of a locus length of the output of the sub $O_2$ sensor 24 (catalyst deterioration detection characteristic value) measured when the oxygen is provided. A target air/fuel ratio (A/F) to be reached by feedback control on the basis of detection by the main $O_2$ sensor 23 will be referred as to "main FB target A/F" in a description made below with reference to FIGS. 2 and 3.

Figure 2:
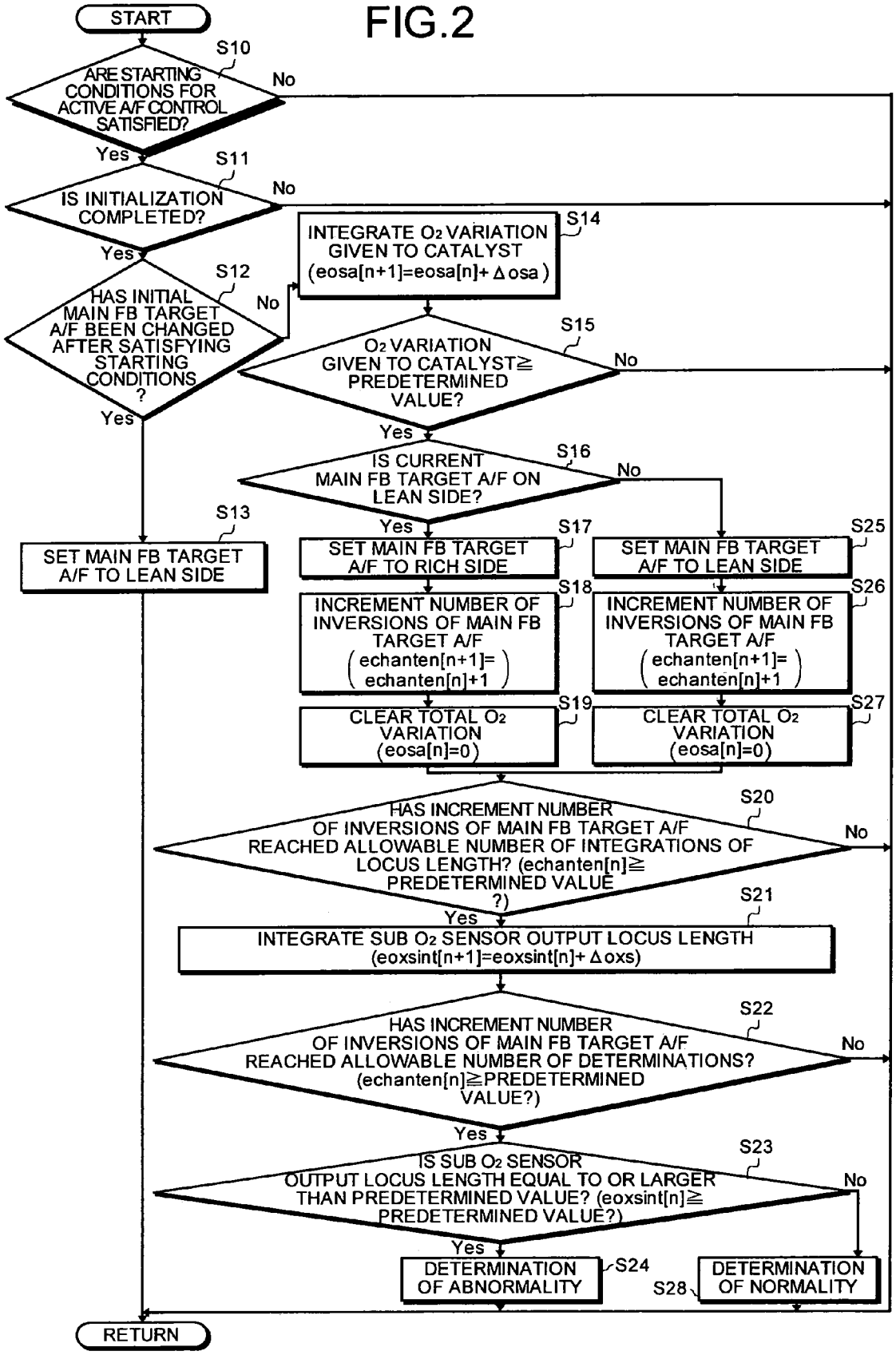
FIG. 2 is a flowchart of a control operation in the embodiment.

A control operation for detecting deterioration of a catalyst will be described with reference to FIG. 2. FIG. 2 is a flowchart of a control operation in this embodiment. Referring to FIG. 2, determination is first made as to whether or not conditions for starting the active A/F control are satisfied (step S10). If the starting conditions are not satisfied (No in step S10), the process returns to START. If the starting conditions are satisfied (Yes in step S10), determination is made as to whether or not initialization of the control is completed (step S11).

In a routine for this initialization shown in FIG. 3, determination is made as to whether or not a catalyst 21 initialization completion flag 'xinit' is ON (step S31). If the flag is ON (Yes in step S31), the process returns to the step S11 in the main routine shown in FIG. 2 and advances to step S12. FIG. 3 is a flowchart of a control routine for initialization.

If the flag 'xinit' is not ON (No in step S31), the main FB target A/F is set to a value on the rich side for execution of the initialization (step S32). For example, if the target A/F during normal stoichiometric control is about 14.6, the control target value is set to a value on the rich side to be about 14.1. Thus, the main FB target A/F is first set to the rich side to reduce the amount of oxygen stored in the catalyst 21 to substantially zero, and the catalyst is thereby reset to an oxygen storable condition. In this way, the amount of NOx emission that tends to increase abruptly due to the characteristics of the three way catalyst can be limited.

Oxygen variation 'eosa' given to the catalyst 21 is integrated (step S33). That is, a total of the oxygen variations 'eosa' given to the catalyst is calculated as shown by the following Equation (1), wherein n in parentheses is an integer (the same definition will apply below) and Δosa is a given variation.

$$eosa[n+1]=eosa[n]+\Delta osa \quad (1)$$

Subsequently, determination is made as to whether or not the total oxygen variation given to the catalyst 21 is equal to or larger than a predetermined value (step S34). If the total oxygen variation is smaller than the predetermined value (No in step S34), the process returns to START. If the total oxygen variation is equal to or larger than the predetermined value (Yes in step S34), the initialization completion flag 'xinit' is set to ON (step S35), and the process returns to step S11 in the main routine shown in FIG. 2.

If the initialization of the control is completed (Yes in step S11), determination is made after satisfying the starting conditions in step S10 as to whether or not the initial main FB target A/F has been changed (step S12). If the initial main FB target A/F has been changed (Yes in step S12), the main FB target A/F is set to a value on the lean side (step S13). For example, if the target A/F during normal stoichiometric control is about 14.6, the control target value is set to a value on the lean side to be about 15.1.

If the initial main FB target A/F has not been changed (No in step S12), the oxygen variation 'eosa' given to the catalyst 21 is integrated (step S14). That is, the total of the oxygen variations 'eosa' given to the catalyst 21 is calculated by Equation (1).

Subsequently, determination is made as to whether or not the total oxygen variation given to the catalyst 21 is equal to or larger than a predetermined value (step S15). If the total oxygen variation is smaller than the predetermined value (No in step S15), the process returns to START. If the total oxygen variation is equal to or larger than the predetermined value (Yes in step S15), determination is made as to whether or not the current main FB target A/F is on the lean side (step S16). For example, if the target A/F during normal stoichiometric control is about 14.6, determination is made as to whether or not the current main FB target A/F is about 15.1.

Figure 4:
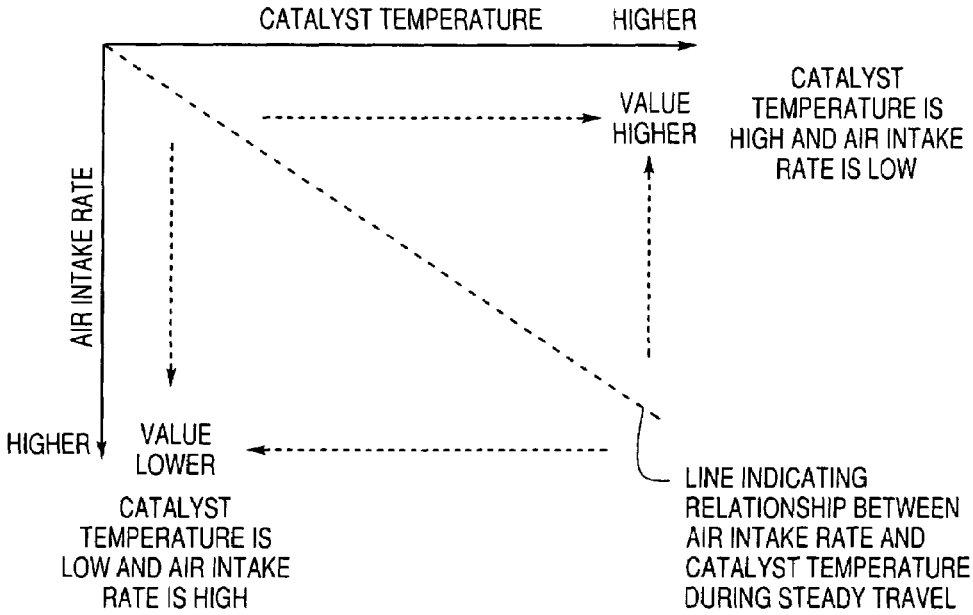
FIG. 4 is a map in which the total oxygen variation given to a catalyst is mapped with respect to the catalyst temperature and the air intake rate.

The predetermined value compared with the total oxygen variation given to the catalyst 21 is set on the basis of a map arranged with respect to the temperature of the catalyst 21 and the air intake rate (load) as shown in FIG. 4. FIG. 4 is a map in which the total oxygen variation given to the catalyst 21 is mapped with respect to the catalyst temperature and the air intake rate.

For example, the total oxygen variation given to the catalyst 21 determined as a value to be set during steady travel is set to a larger value when the catalyst temperature is high and when the air intake rate is low, and is set to a smaller value when the catalyst temperature is low and when the air intake rate is high. In this way, the occurrence of a state in which the output from the sub $O_2$ sensor 24 for the normal catalyst 21 is inverted by an excessively large amount of oxygen given in a transient operating condition to reduce the detection S/N can be limited, and a worsening of the NOx emission due to an unnecessary lean output from the sub $O_2$ sensor 24 can also be limited.

The oxygen variation given to the catalyst 21 may be set by multiplying a predetermined weighting coefficient according to the catalyst temperature and the air intake rate (load) in every calculation in integration of the oxygen variation given to the catalyst in step S14, instead of being set on the basis of a map in which it is mapped with respect to the temperature of the catalyst 21 and the air intake rate (load) as described above.

The predetermined value compared with the total oxygen variation is set so as to be larger at the time of control of the target A/F on the rich side than at the time of control on the lean side, thereby reducing the bad influence of a capacity error, i.e., an excess of OSC of the catalyst 21 over the oxygen release capacity, on analysis of deterioration of the catalyst 21. That is, under control of alternating target A/F rich or lean, it can be limited that the center of oscillation caused by the alternating is shifted to the lean side to cause inversion of the output from the sub $O_2$ sensor 24 for the normal catalyst 21 to reduce the detection S/N. Also, a worsening of the NOx emission due to an unnecessary lean output from the sub $O_2$ sensor 24 can also be limited.

If the present main FB target A/F is on the lean side (Yes in step S16), the main FB target A/F is set to a value on the rich side (step S17). For example, if the target A/F during normal stoichiometric control is about 14.6, the control target value is set to about 14.1.

Then a counter count 'echanten' indicating the number of times the main FB target A/F has been inverted is incremented by one (step S18) as shown by the following Equation (2):

$$echanten[n+1]=echanten[n]+1 \quad (2)$$

Subsequently, the integral 'eosa' of the oxygen variation given to the catalyst 21 is cleared as shown in the following Equation (3):

$$eosa[n]=0 \quad (3)$$

If it is determined in step S16 that the current main FB target A/F is not on the lean side (Yes in step S16), the main FB target A/F is set to a value on the lean side (step S25). For example, if the target A/F during normal stoichiometric control is about 14.6, the control target value is set to about 15.1.

Then 'echanten' (counter count), i.e., the number of times the main FB target A/F has been inverted, is incremented by one (step S26) as shown by the following Equation (4):

$$echanten[n+1]=echanten[n]+1 \quad (4)$$

Subsequently, the integral 'eosa' of the oxygen variation given to the catalyst 21 is cleared (step S27) as shown by the following Equation (5):

$$eosa[n]=0 \quad (5)$$

Thus, the main FB target A/F is inverted by being set to a value on the rich side if it is presently on the lean side (Yes in step S16, step S17), and is inverted by being set to a value on the lean side if it is presently on the rich side (No in step S16, step S25).

After the integral 'eosa' of the oxygen variation given to the catalyst 21 has been cleared (steps S19, S27), determination is made as to whether or not the number of times 'echanten' the main FB target A/F has been inverted has reached a predetermined allowable number of integrations of the locus length as shown by the following Equation (6) (step S20).

$$\text{echanten}[n] \geqq \text{predetermined value} \quad (6)$$

If the number of times 'echanten' the main FB target A/F has been inverted has not reached the predetermined allowable number of integrations of the locus length, the process returns to START (No in step S20). If the number of times 'echanten' the main FB target A/F has been inverted has reached the predetermined allowable number of integrations of the locus length (Yes in step S20), the locus length 'eoxsint' of the output from the sub $O_2$ sensor 24 is integrated as shown by the following Equation (7) (Step S21):

$$eoxsint[n+1]=eoxsint[n]+\Delta oxs \quad (7)$$

As described above, integration of the locus length of the output from the sub $O_2$ sensor 24 is inhibited before the predetermined number of inversions is reached after a start of control to avoid catalyst abnormality diagnosis when the output data from the sensor 24 is unstable, thus limiting deterioration of the catalyst abnormality detection performance. In step S20, integration of the locus length may be performed not upon the detection of the predetermined number of inversions but upon detection of a lapse of a predetermined time period.

Subsequently, determination is made as to whether or not the number of times the main FB target A/F has been inverted has reached a predetermined allowable number of determinations, as shown in the following Equation (8) (step S22):

$$echanten[n] \geqq \text{predetermined value} \quad (8)$$

If the number of times 'echanten' the main FB target A/F has been inverted has not reached the predetermined allowable number of determinations, the process returns to START (No in step S22). If the number of times 'echanten' the main FB target A/F has been inverted has reached the predetermined allowable number of determinations (Yes in step S22), determination is then made as to whether or not the locus length 'eoxsint' of the output from the sub $O_2$ sensor 24 is equal to or larger than a predetermined value, as shown by the following Equation (9) (step S23):

$$echanten[n] \geqq \text{predetermined value} \quad (9)$$

If the locus length 'eoxsint' of the output from the sub $O_2$ sensor 24 is equal to or larger than the predetermined value (Yes in step S23), it is determined that the catalyst 21 is abnormal (step S24). If the locus length 'eoxsint' of the output from the sub $O_2$ sensor 24 is smaller than the predetermined value (No in step S23), it is determined that the catalyst 21 is normal (step S24) and the process returns to STEP.

Figure 5:
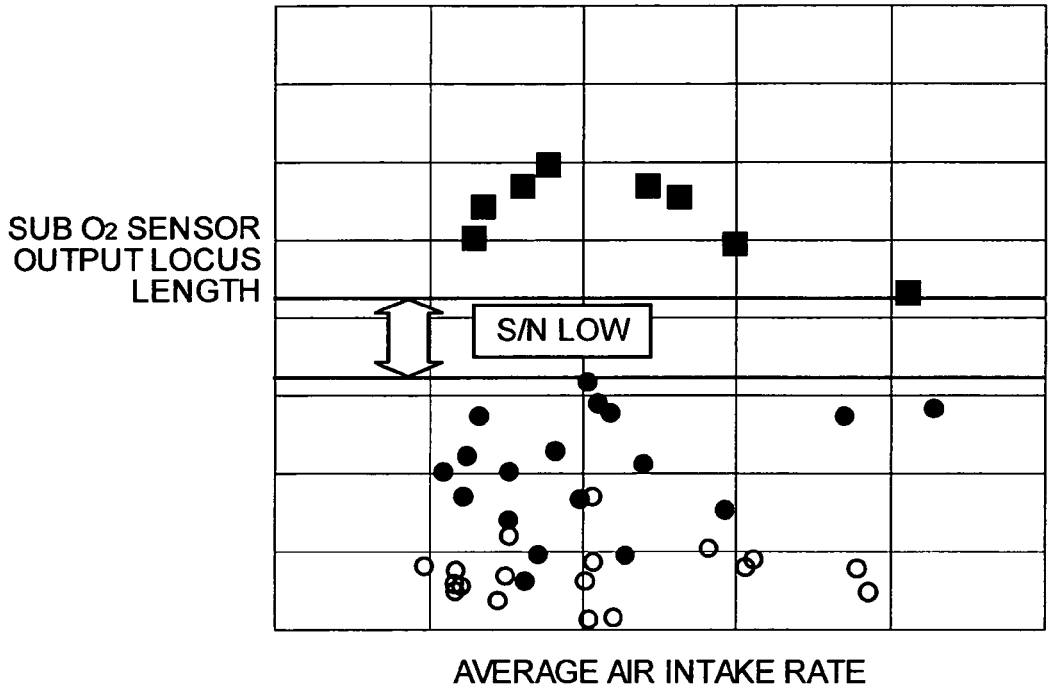
FIG. 5 is a graph showing the relationship between the locus length of the output from a sub $O_2$ sensor and the average intake air rate in a case where the conventional technique is used.
Figure 6:
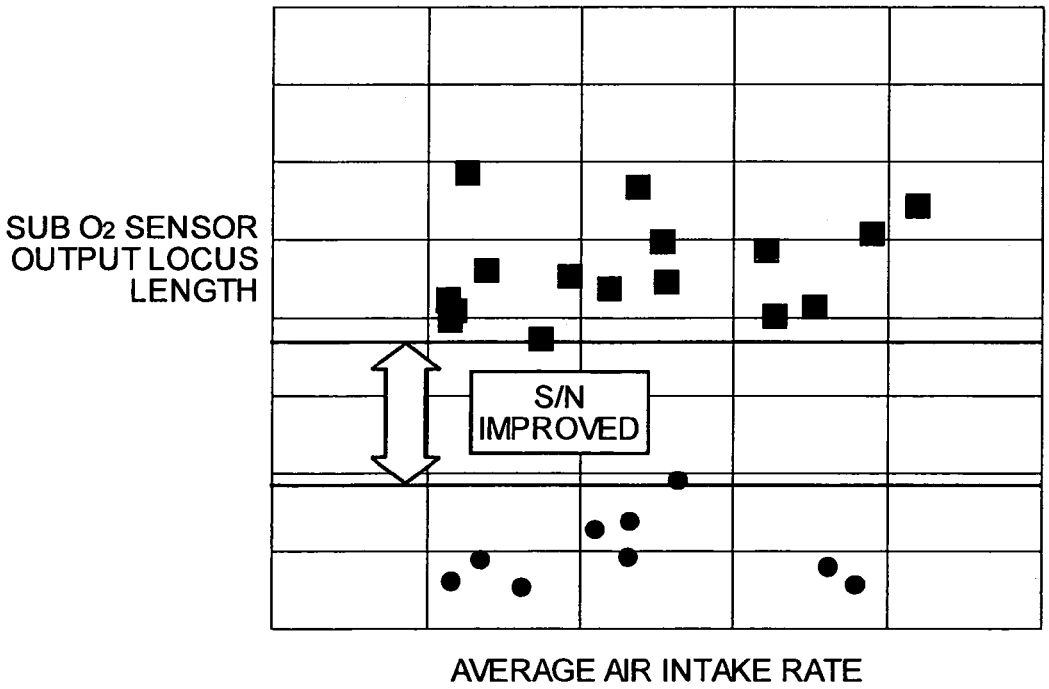
FIG. 6 is a graph showing the relationship between the locus length of the output from the sub $O_2$ sensor and the average intake air rate in the embodiment of the present invention.

The effect of the present invention will be described with reference to FIGS. 5 and 6. FIG. 5 is a graph showing the relationship between the locus length of the output from the sub $O_2$ sensor and the average intake air rate in a case where the conventional technique is used, and showing the S/N rate of detection of normality and abnormality of the catalyst 21. FIG. 6 is a graph showing the relationship between the locus length of the output from the sub $O_2$ sensor and the average intake air rate in this embodiment, and showing the S/N rate of detection of normality and abnormality of the catalyst 21. In FIGS. 5 and 6, a black square mark indicates the case of the catalyst in an abnormal condition, while each of black and blank round mark indicates the catalyst in a normal condition.

As can be understood from the comparison between these graphs, the S/N rate of detection or normality and abnormality of the catalyst can be improved and the accuracy of catalyst deterioration diagnosis can be increased in this embodiment in comparison with the case of using the conventional technique.

Figure 7:
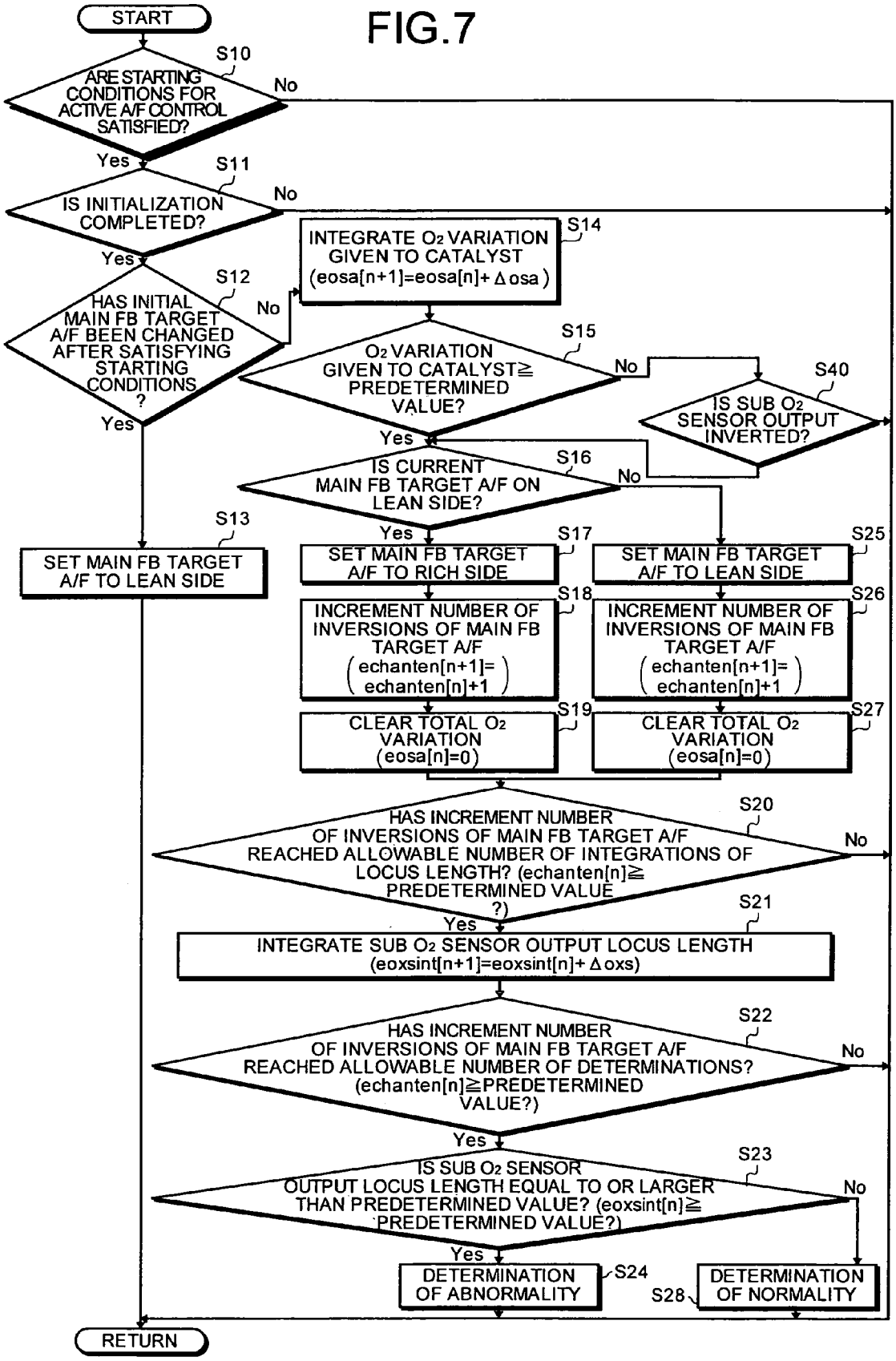
FIG. 7 is a flowchart of another example of the control operation.

As shown in FIG. 7, a step S40 of determining whether or not the output from the sub $O_2$ sensor 24 has been inverted may be provided between steps S15 and S16 shown in FIG. 2 in order to further limit worsening of emissions. FIG. 7 is a flowchart showing another example of the control operation.

That is, if the output from the sub $O_2$ sensor 24 is inverted before the oxygen variation given to the catalyst 21 reaches the predetermined value (Yes in step S40), the process moves to step S16. If the output from the sub $O_2$ sensor 24 is not inverted before the oxygen variation given to the catalyst 21 reaches the predetermined value (No in step S40), the process is controlled to return to START. Other control steps are the same as those shown in FIG. 2.

Thus, the occurrence (duration) of a state in which a target AF exceeding the OSC of the catalyst can be minimized to further reduce worsening of emissions.

The embodiment has been described by assuming that catalyst 21 initialization processing is performed by first setting the main FB target A/F to a value on the rich side in step S32 shown in FIG. 2 and thereafter executing step S12 and the other subsequent steps shown in FIG. 1. However, this initialization is not exclusively performed. Setting to a value on the lean side may alternatively be made before execution of the subsequent control.

In this case, there is a possibility of slight worsening of the NOx emission due to an unnecessary lean output from the sub $O_2$ sensor 24 in comparison with the above-described embodiment. However, the locus length of the output from the sub $O_2$ sensor 24 can be stabilized in comparison with the above-described conventional technique, thereby reducing the degree of emission worsening.

As described above the catalyst deterioration detecting apparatus for an internal combustion engine in accordance with the present invention is capable of accurately detecting deterioration of the catalyst and is useful for internal combustion engines design to limit worsening of emissions.

According to the catalyst degradation detecting apparatus of the embodiment, the amount of oxygen storage in the catalyst is reset to substantially zero in a case where the air/fuel ratio is first biased to a rich amount. Besides, the amount of oxygen storage in the catalyst is reset to a substantially saturated amount in a case where the air/fuel ratio is first biased to a lean amount. As a result, the oxygen storage amount at the time of a start of detecting degradation of a catalyst is thereby made determinate, thus enabling catalyst degradation diagnosis to be performed with accuracy.

According to the catalyst degradation detecting apparatus of the embodiment, the bad influence of a capacity error, i.e., an excess of the oxygen storage capacity of the catalyst over the oxygen release capacity, on analysis of degradation of the catalyst.

According to the catalyst degradation detecting apparatus of the embodiment, catalyst abnormality diagnosis is not performed when the output data from the oxygen level sensor is unstable, thereby limiting deterioration of the catalyst abnormality detection performance.

Additional advantages and modifications will readily occur to those skilled in the art. Therefore, the invention in its broader aspects is not limited to the specific details and representative embodiments shown and described herein. Accordingly, various modifications may be made without departing from the sprit or scope of the general inventive concept as defined by the appended claims and their equivalents.

What is claimed is:

1. An apparatus for detecting deterioration of a catalyst in an internal combustion engine, the apparatus:

initially biases an air/fuel ratio of an air-fuel mixture supplied to the internal combustion engine to a rich amount so that an amount of oxygen stored in the catalyst is substantially zero; and detects deterioration of the catalyst by alternating the air/fuel ratio lean or rich based on an amount of oxygen given to the catalyst, wherein a bias amount of the air/fuel ratio is set so that the amount of oxygen stored in the catalyst is substantially saturated if the catalyst has deteriorated, and the bias amount of the air/fuel ratio is set so that the amount of oxygen stored in the catalyst is not saturated if the catalyst is normal.

2. The apparatus according to claim 1, wherein an amount of oxygen given to the catalyst for biasing the air/fuel ratio to a rich amount is larger than an amount of oxygen given to the catalyst for biasing the air/fuel ratio to a lean amount.

3. The apparatus according to claim 1, wherein detecting deterioration of the catalyst is not performed in a predetermined time period after a start of alternating the air/fuel ratio lean or rich.

4. An apparatus for detecting deterioration of a catalyst in an internal combustion engine, the apparatus:

initially biases an air/fuel ratio of an air-fuel mixture supplied to the internal combustion engine to a lean amount so that an amount of oxygen stored in the catalyst is substantially saturated; and detects deterioration of the catalyst by alternating the air/fuel ratio lean or rich based on an amount of oxygen given to the catalyst, wherein a bias amount of the air/fuel ratio is set so that the amount of oxygen stored in the catalyst is substantially saturated if the catalyst has deteriorated, and the bias amount of the air/fuel ratio is set so that the amount of oxygen stored in the catalyst is not saturated if the catalyst is normal.

5. The apparatus according to claim 4, wherein an amount of oxygen given to the catalyst for biasing the air/fuel ratio to a rich amount is larger than an amount of oxygen given to the catalyst for biasing the air/fuel ratio to a lean amount.

6. The apparatus according to claim 4, wherein detecting deterioration of the catalyst is not performed in a predetermined time period after a start of alternating the air/fuel ratio lean or rich.

7. A method of detecting deterioration of a catalyst in an internal combustion engine, the method comprising:

if initially biasing an air/fuel ratio of an air-fuel mixture supplied to the internal combustion engine to a rich amount, setting a target air/fuel ratio so that an amount of oxygen stored in the catalyst to substantially zero;

if initially biasing an air/fuel ratio of an air-fuel mixture supplied to the internal combustion engine to a lean amount, setting a target air/fuel ratio so that an amount of oxygen stored in the catalyst to substantially saturated; and detecting deterioration of the catalyst by alternating the air/fuel ratio lean or rich based on an amount of oxygen given to the catalyst, wherein a bias amount of the air/fuel ratio is set so that the amount of oxygen stored in the catalyst is substantially saturated if the catalyst has deteriorated, and the bias amount of the air/fuel ratio is set so that the amount of oxygen stored in the catalyst is not saturated if the catalyst is normal.

* * * * *